United States Patent [19]

Miller

[11] Patent Number: 4,742,782

[45] Date of Patent: May 10, 1988

[54] SHEET METAL SHELVING ASSEMBLY

[75] Inventor: Daniel R. Miller, Cincinnati, Ohio

[73] Assignee: Fort Steuben Products Inc., Weirton, W. Va.

[21] Appl. No.: 9,070

[22] Filed: Jan. 27, 1987

Related U.S. Application Data

[63] Continuation of Ser. No. 631,399, Jul. 16, 1984, abandoned.

[51] Int. Cl.[4] ..... A47B 3/00

[52] U.S. Cl. ..... 108/111; 211/187

[58] Field of Search ..... 108/111, 107, 114, 156; 248/243; 211/187, 186, 135

[56] References Cited

U.S. PATENT DOCUMENTS

| | | | |
|---|---|---|---|
| 2,621,800 | 12/1952 | Neubauer | 108/114 |
| 2,798,770 | 7/1957 | Terrick . | |
| 3,014,596 | 12/1961 | Gingher et al. . | |
| 3,229,790 | 1/1966 | Shayne | 108/111 X |
| 3,332,374 | 7/1967 | Ferdinand et al. | 108/107 |
| 3,677,416 | 7/1972 | Block et al. . | |
| 3,766,863 | 10/1973 | Swick, Jr. et al. . | |
| 3,881,428 | 5/1975 | Klecki | 108/156 X |
| 3,888,192 | 6/1975 | Basey . | |
| 4,165,698 | 8/1979 | Ferdinand | 108/156 |
| 4,307,985 | 12/1981 | Desprez et al. | 108/55.1 X |
| 4,351,244 | 9/1982 | Suttles . | |
| 4,359,947 | 11/1982 | Marschak | 108/111 X |
| 4,518,279 | 5/1985 | Suttles | 211/189 X |
| 4,556,148 | 12/1985 | Koller | 108/111 X |
| 4,558,647 | 12/1985 | Peterson | 108/111 X |
| 4,564,111 | 1/1986 | Suttles | 108/111 |
| 4,643,319 | 2/1987 | Debus et al. | 211/189 |
| 4,648,517 | 3/1987 | Schäfer | 211/189 X |

*Primary Examiner*—Kenneth J. Dorner
*Assistant Examiner*—José V. Chen
*Attorney, Agent, or Firm*—Fay, Sharpe, Beall, Fagan, Minnich & McKee

[57] ABSTRACT

The nut and bolt connection between bent metal columns and shelves: is easy to assemble because the bolt apertures through the shelf skirts are spaced downwardly from the shelf main planar support surface a distance sufficient to permit easy finger access for the nut; is easy to assembly because the skirt includes a return bend portion forming an upwardly facing nut locking surface to prevent rotation of the nut during assembly; is secure because the skirt is formed of spaced apart walls that will compress and bias the nut, bolt assembly, particularly with an interlocking upper portion of the walls to provide for symmetrical compressions; is secure due to the columns being biased or stressed during assembly to bias the nut and bolt threads; and is strengthened in the column margins by bent portions that also increase safety.

47 Claims, 2 Drawing Sheets

SHEET METAL SHELVING ASSEMBLY

This application is a continuation of application Ser. No. 631,399, filed July 16, 1984, now abandoned.

BACKGROUND OF THE INVENTION

The present invention relates to the field of bent metal shelving. Despite this field being highly developed, there have always been the problems of increasing strength without the expenditure of additional material, improving the ease of assembly, improving the reliability of the shelf with respect to remaining assembled, and improving safety.

In the prior art, these desirable results or problems, depending upon the viewpoint, have been the subject of invention with varying degrees of success, but there is always room for improvement.

SUMMARY

In general, it is an object of the present invention to reduce the above-mentioned problems by correspondingly providing improvements in the mentioned areas. Although the claims are the true measure of the invention, the nut and bolt connection between bent metal columns and shelves: is easy to assemble because the bolt apertures through the shelf skirts are spaced downwardly from the shelf main planar support surface a distance sufficient to permit easy finger access for the nut; is easy to assemble because the skirt includes a return bend portion forming an upwardly facing nut locking surface to prevent rotation of the nut during assembly; is secure because the skirt is formed of spaced apart walls that will compress and bias the nut, bolt assembly, particularly with an interlocking upper portion of the walls to provide for symmetrical compressions; is secure due to the columns being biased or stressed during assembly to bias the nut and bolt threads; and is strengthened in the column margins by bent portions that also increase safety.

BRIEF DESCRIPTION OF THE DRAWINGS

Further objects, features and advantages of the present invention will become more clear from the following detailed description of a preferred embodiment, shown in the drawings, wherein.

DETAILED DESCRIPTION OF THE PREFERRED EMBODIMENT

Figure 1:
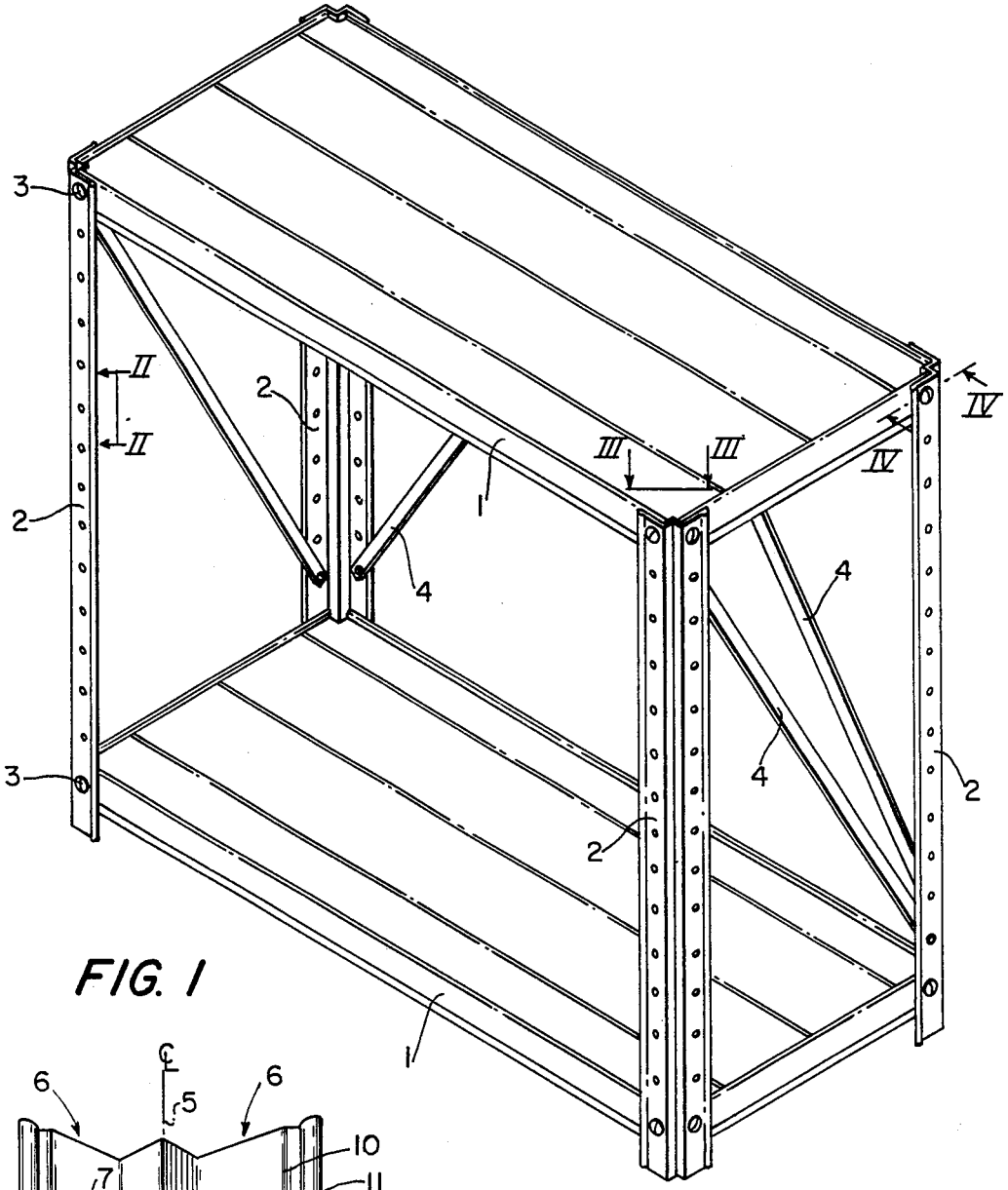
FIG. 1 is a perspective elevation view of shelving employing the features of the present invention as seen from line II—II in FIG. 1.

Essentially, the shelving consists of at least one shelf 1 (two being shown in FIG. 1, although any number may be employed), a column 2 (four being shown in FIG. 1, although more or less may be provided for each shelf, for example when shelving is connected side by side using one column between two adjacent shelves) and fasteners 3 (nuts and bolts being shown, although other compressive type fasteners may be employed according to the broader aspects). In FIG. 1, conventional bracing 4 is shown by way of an example of conventional structure that may be employed with the features of the present invention, although not being necessary. The shelves, columns, and optionally bracing are constructed solely of bent sheet metal, that is each is constructed of a single sheet of metal, preferably thin steel, that is cut and bent into the shape employed. Of course, coatings and the like may be applied on the steel, for example protective and decorative paint, or plastic sleeve feet for the columns, which are conventional features employed by steel shelving.

Figure 2:
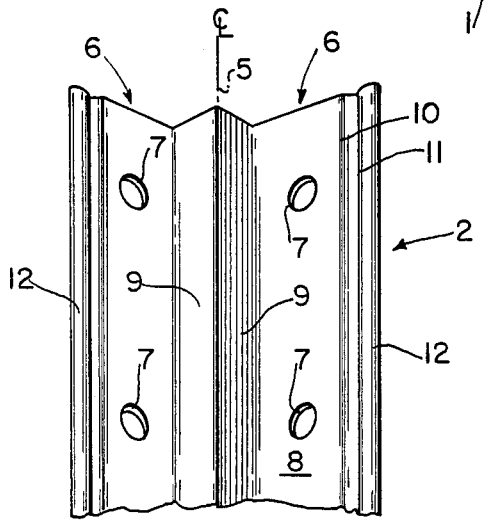
FIG. 2 is a partial perspective view.

As shown in FIG. 2, all of the columns are identical, so that only one is shown in detail. Each column is symmetrical about a vertical center line 5. On each side of the centerline is a side wall 6. Only one side wall is necessary for a shelf, for example two horizontally adjacent shelves may be connected together by only a single column and therefore two side walls will be associated with one shelf, one of which side walls will be common to the other shelf. Each side wall is provided with one or more through horizontal apertures 7, which are preferably evenly spaced from each other and vertically aligned with respect to each other.

Figure 3:
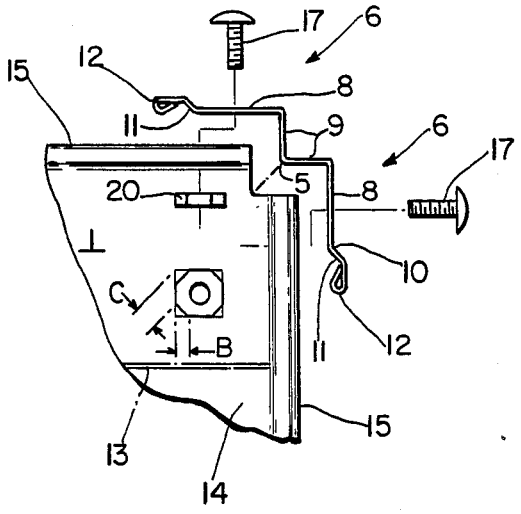
FIG. 3 is a top plan view of one corner as seen from line III—III in FIG. 1.

As seen in FIG. 3 in plan view (this view would be substantially the same as a cross-sectional view), the columns are of a W-shape having outermost legs effectively formed by the side walls 6. Innermost legs 9 are perpendicular to each other where they are joined at the centerline 5, and the innermost legs are also perpendicular to the outermost legs 8, where they are integrally joined through a bend along margins opposite to the mutually joined margins at the centerline 5. Each of the outermost legs 8 has a major side wall portion extending from the integral connection with the innermost leg 9 outwardly to a bent margin 10, a transversely extending flange 11, and a U-shaped return terminal flange 12, which may be closed upon itself in a loop as specifically shown in the drawing, all of which are serially connected together. The U-shaped return terminal flange 12 is of a width, as measured perpendicular to the side wall portion 8, substantially equal to the width of the transversely extending flange 10 so that the column side wall 6 may be in its entirety clamped against a planar surface, namely the skirt to be described. Within the range intended, the U-shaped return terminal flange 12 may in fact extend inwardly towards the shelf more than side wall portion 8, so that it may be stressed into the planar condition during assembly, or outwardly beyond the aligned position, or may be of a different width, plus or minus, for similar effects. The main aspects of this feature are that the side walls are capable of being clamped against a vertical planar surface, the terminal edge is reversely bent back and a transverse flange is provided to allow some space for the return terminal flange. The return terminal flange 12 and transverse flange 10 add column strength to a far greater amount than would be proportional to the increased material used and further provide a safe marginal edge so that fingers and the like cannot be easily damaged on the edges.

Preferably the shelves are identical to each other, so that only one will be described in detail. The shelf has a main planar support portion 14 that is rectangular and horizontally arranged between the four columns, as illustrated, which columns are at the four corners of the rectangle. A plurality of ribs 13 are provided (bent) in the planar support portion 14. These ribs 13 are preferably parallel to each other and preferably extend in the elongated direction of the rectangular planar support portion 14. The shelf includes an integrally formed generally vertically extending or more preferably depending skirt portion 15, preferably along each edge or around the entire periphery of the shelf 1. Each of the four skirts 15 includes, at each of its opposite ends adjacent the shelf corners, at least one through aperture 16, which horizontally extends in alignment with a selected aperture 7 in the adjacent column 2 for the reception of a threaded bolt 17. The bolt 17 has a head 18, which may be provided with a tool engaging portion 19, a slot being illutrated. A nut 20 is threaded on the inside end of the bolt 17 to supportingly clamp the shelf 1 on the column 2. The assembled position is shown in FIG. 4, whereas an exploded or unassembled position is shown in FIG. 3.

Figure 4:
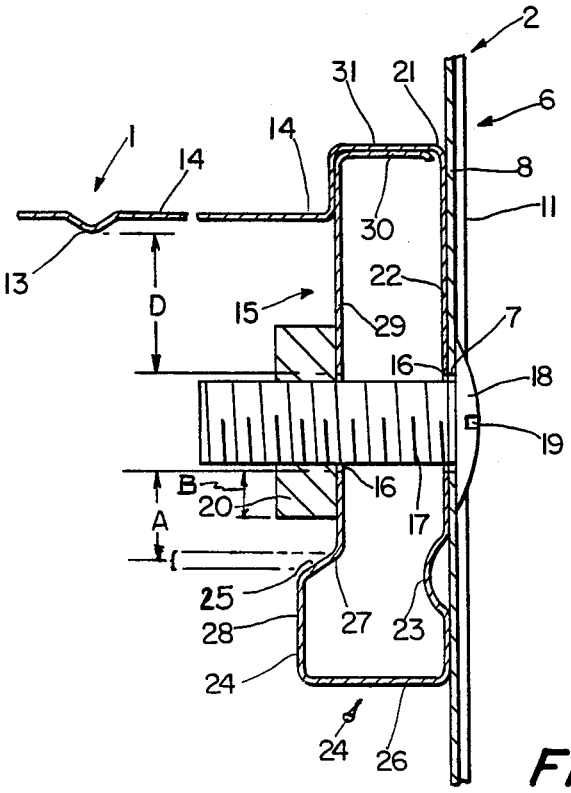
FIG. 4 is an enlarged cross-sectional view taken along line IV—IV in FIG. 1.

All four of the skirts may have the identical construction shown in FIG. 4 in detail, or they may have portions of the structure shown in FIG. 4. Most preferably, the opposed parallel front and rear skirts (along the long dimension of the shelf) are constructed as shown n FIG. 4; whereas the end skirts that are parallel to each other, extend along the short ends of the shelves and are perpendicular to the long skirts, have a more simplified structure to be described.

Preferably, all of the four skirts have the following structure: an upper portion 21 that is integral in one piece with the sheet metal of the planar support portion 14, that is generally of a downwardly opening channel or U-shape; a depending outer wall portion 22, having therein an inwardly extending rib 23 that extends horizontally for the full length of the skirt; and an inwardly and upwardly bent sheet metal portion 24.

For the end skirts, the inwardly and upwardly bent sheet metal portion 24 would be smaller and bent back upon itself (not shown in detail) in the same manner as shown in FIG. 3 with respect to the portions 12.

In addition to that described above, the front and rear skirts have the additional structure shown in FIG. 4, namely: the portion 24 may also be described as an inwardly bent sheet metal lower return portion forming an upper facing nut locking surface 25 spaced from the aperture 16 a distance A. As shown in FIG. 3, one of the nuts 20 has been rotated 90° from its assembly position to illustrate a minimum nut width B defined as the nut thickness perpendicular to the nut axis as measured between the side wall of the threaded hole and the adjacent closest outer side wall of the nut; the maximum nut width thickness is C, which is measured in the same way, but with respect to the maximum thickness. The distance B is at least less than the distance C and substantially equal to the distance A, so that the nut locking surface 25 will, in cooperation with the confining aperture 16 that limits the transverse shifting of the bolt, prevent rotation of the nut 20 after the nut 20 is initially threaded onto the bolt 17 at least to an extent sufficient to permit tightening of the nut and bolt assembly without requiring the placement of a tool on the nut 20. The aperture 16 is located a distance D from the adjacent under surface of the planar support portion 14 that is substantially greater than any of the distances A, B, C, so that the undersurface of the shelf does not limit access, more particularly does not interfere with the fingers gripping the nut 20 during initial assembly of the nut 20 onto the bolt 17, to facilitate assembly. Therefore, the nut may be easily initially threaded onto the bolt passing through the aligned apertures 16 in the skirt and 7 in the column and thereafter the nut 20 will not turn when tightened and will hold against turning due to positive interference between the nut maximum width portion and the nut locking surface 25.

The above-mentioned skirt lower return portion 24 may be described as being generally of J-shape, with the long leg 26 and short leg 27 of the J-shape being horizontal. The short leg 27 forms the upwardly facing nut locking surface 25 (in a more simplified version, for example with respect to the end skirts, the nut locking surface 25 may be merely the edge of the web 28 of what is shown as the J-shape in FIG. 4, this modification not being shown). The skirt portion further includes an upwardly extending inner wall portion 29 generally coextensive with, spaced from and parallel to the outer wall portion 22 and having a through aperture 16 therein aligned with the aperture 16 in the outer wall portion 22 for receiving the bolt 17. Therefore, it may be seen that tightening of the nut and bolt will compress the inner wall portion 29 and the outer wall portion 22 towards each other in a resilient manner to thereby exert a bias on the threads of the assembled nut and bolt to resist disassembly much in the same manner that a Belleville washer or other lock type washer will exert a bias on a nut and bolt assembly to resist disassembly. Therefore, a lock washer is not needed. In fact, no washers are needed.

The skirt portion as shown in FIG. 4 further includes a terminal flange 30 integrally extending outwardly from the uppermost portion of the inner wall portion 29 and generally horizontally to the inside surface of the outer wall portion 22, so that compression of the inner wall portion 29 and outer wall portion 22 by tightening the nut and bolt will symmetrically compress the inner and outer wall portions 29, 22 only at their mid portions as the uppermost and lowermost portions of the inner and outer walls 29, 22 are respectively held at their intitial spacing by the lower return portion 24 and the upper terminal flange 30.

The planar support portion 14 of the shelf 1 includes an upwardly extending integral rib 31 at least for the skirt shown in FIG. 4, preferably for both the front and rear skirts, and most preferably for all four skirts or for all four edges of the shelf or around the entire periphery of the shelf. At least for a skirt structure as shown in FIG. 4, this rib 31 will nestingly receive therein the terminal return flange 30 in an interlocking manner. Thereby, the upwardly extending integral rib 31, in addition to receiving in a locking manner the return flange 30, also both reinforces the shelf by increasing its beam strength and forms an upwardly extending ledge around the periphery of the shelf to resist sliding movement of articles supported on the shelf in a direction off of the periphery of the shelf.

As shown in FIG. 4, the rib 23 has the additional function of matching the strengthing characteristic provided by the leg 27, which is generally parallel to it and horizontally aligned. Because of this strengthening matched for the inner wall portion 29 and outer wall portion 22, the symmetry of the clamping provided by the bolt is improved.

As shown in FIG. 3, which is true with respect to all four corners, adjacent depending skirt portions at each corner of the shelf are spaced from each other to receive therebetween the innermost legs 9 of the adjacent column 2. Effectively, a notch is formed at each corner of each shelf to mate with the shape of the innermost legs 9. Preferably, the column is bent and fixed into the shape shown in the unassembled condition of FIG. 3, wherein the angle formed between the outermost legs is sufficiently obtuse that when the column is assembled the outermost legs 8 will be resiliently bent to a generally right angular relationship to thereby exert a bias on the threads of the assembled nut and bolt to resist disassembly of the nut and bolt in the manner of a lock washer. That is, there is a perpendicular orientation of the outermost legs 8 and innermost legs 9 when assembled, but these legs have an orientation from the assembled perpendicular orientation toward a planar relationship when in the relaxed unassembled position shown in FIG. 3 so that when assembled each column will exert a bias on the threads of the assembled nut and bolt to resist disassembly.

The operation, advantages and functions of the preferred embodiment have been set forth along with illustrated variations. Further embodiments, modifications and variations are contemplated in addition to the advantageous details, all in accordance with the spirit and scope of the following claims.

I claim:

1. In shelving, comprising, a plurality of bent sheet metal columns to be vertically arranged in spaced parallel relationship, and each having at least one sheet metal side wall having at least one horizontal aperture, and at least one bent sheet metal shelf having a main planar support portion to be horizontally arranged within said columns, and an integrally formed generally vertically extending skirt portion having a horizontal aperture therethrough to be aligned with the horizontal aperture in an adjacent one column side wall for receiving a threaded bolt therethrough so that a nut threaded on the bolt will supportingly clamp said shelf on said one column, the improvement of:

said skirt portion including: an upper portion integral at the top in one piece with the sheet metal of said planar support portion; an outer wall portion downwardly depending from said upper portion; a lower portion having one part extending inwardly from the bottom of said outer wall portion, another part extending upwardly from said one part for forming an upwardly facing nut locking surface spaced below said aperture in said skirt portion a distance substantially equal to a minimum nut width as measured perpendicular to the nut axis between a side wall of a central threaded bore of the nut and any adjacent closest outer side wall of the nut; and said aperture in said skirt portion being spaced below the adjacent lowermost surface of said planar support portion, a distance substantially greater than said first mentioned distance, so that a nut may be easily initially threaded onto a bolt passing through aligned apertures in said skirt portion and column side wall so that the nut will not thereafter turn during tightening and will hold against turning only due to positive interference with said nut locking surface.

2. The shelving of claim 1, wherein said lower portion of said skirt portion is generally J-shaped, with the long and short legs of the J-shape being horizontal, the short leg forming said upwardly facing nut locking surface;

said skirt portion further including an upwardly extending inner wall portion generally co-extensive with, spaced from and parallel to said outer wall portion and having a through aperture therein aligned with the aperture in said outer wall portion for receiving the bolt, so that tightening of the nut and bolt will compress said inner and outer wall portions towards each other and exert a bias on the threads of said assembled nut and bolt to resist disassembly.

3. The shelving of claim 2, wherein said skirt portion further includes a terminal flange integrally extending outwardly from the uppermost portion of said inner wall portion and generally horizontally to the inside surface of said outer wall portion, so that compression of said inner and outer wall portions by tightening the nut and bolt will symmetrically compress the inner and outer wall portions only at their midportions as the uppermost and lowermost portions of said inner and outer wall portions are respectively held at their initial spacing by said lower return portion and said terminal flange.

4. The shelving of claim 3, wherein said planar support portion includes an upwardly extending integral rib at the periphery having said skirt portion, for nestingly receiving therein said terminal flange in an interlocking manner and so that said upwardly extending integral rib also both reinforces said shelf and forms a ledge to resist sliding movement of articles support on said shelf in a direction off of the periphery.

5. The shelving of claim 4, wherein each of said columns is, in cross-section, of a W-shape having outermost legs formed by two of said column side walls, and shorter interconnecting innermost legs, with said innermost legs being perpendicular to each other and respectively perpendicular to their adjacent outermost legs;

said shelf being of rectangular shape, with depending skirt portions on four sides of the rectangular shape, and adjacent depending skirt portions at each corner of the shelf being spaced from each other to receive therebetween the innermost legs of the adjacent column; and said apertures being aligned in each skirt portion and each column outermost leg for receiving respectively two bolts at each corner.

6. The shelving of claim 3, further comprised of said planar support portions having an integral upwardly extending rib along all four edges for resisting sliding movement of aritcles off of said shelf.

7. The shelving of claim 3, wherein each of said columns is, in cross-section, of a W-shape having outermost legs formed by two of said column side walls, and shorter interconnecting innermost legs, with said innermost legs being perpendicular to each other and respectively perpendicular to their adjacent outermost legs;

said shelf being of rectangular shape, with depending skirt portions on four sides of the rectangular shape, and adjacent depending skirt portions at each corner of the shelf being spaced from each other to receive therebetween the innermost legs of the adjacent column; and said apertures being aligned in each skirt portion and each column outermost leg for receiving respectively two bolts at each corner.

8. The shelving of claim 7, said planar support portion having an integral upwardly extending rib along all four edges for resisting sliding movement of articles off of said shelf.

9. The shelving of claim 1, wherein the outer wall portion of said skirt includes an inwardly extending rib horizontally aligned with the nut locking surface and parallel thereto.

10. The shelving of claim 1, further comprising of said column side wall being planar and adapted to tightly clamp in engagement with said skirt outer wall portion by the nut and bolt.

11. Shelving, comprising:

a plurality of bent sheet metal columns to be vertically arranged in spaced parallel relationship, and each having at least one sheet metal side wall having at least one horizontal aperture;

at least one bent sheet metal shelf having a main planar support portion to be horizontally arranged within said columns, and an integrally formed generally vertically extending skirt portion having a horizontal aperture therethrough to be aligned with the horizontal aperture in an adjacent one column side wall for receiving a threaded bolt therethrough so that a nut threaded on the bolt will supportingly clamp said shelf on said one column;

said skirt portion including an upper portion integral in one piece with the sheet metal of said planar support portion, and a depending generally planar outer wall portion;

each of said columns being in cross-section, of a W-shape having outermost legs formed by two of said column side walls, and shorter interconnecting innermost legs, with said innermost legs being perpendicular to each other and respectively perpendicular to their adjacent outermost legs;

said shelf being of rectangular shape, with depending skirts on four sides of the rectangle, adjacent depending skirt portions at each corner of the shelf being spaced from each other to receive therebetween the innermost legs of the adjacent column;

said apertures being aligned in each skirt portion and each column outermost leg for receiving respectively two bolts at each corner;

for each column, the outermost portion of each of said outermost legs having a major side wall portion, as seen in cross-section, integral at one end with the remainder of said W-shape and integral at its other end with a transversely extending flange, and U-shaped return terminal flange, serially connected together; and said U-shaped return terminal flange being of a width, as measured perpendicular to said major side wall portion, substantially equal to the width of said transversely extending flange, so that said column side wall in its entirety may be tightly clamped against and in engagement with a planar surface of said skirt.

12. The shelving of claim 11, wherein the orientation of the outermost legs of the W-shape of each of said columns is substantially perpendicular when assembled, and said legs are oriented from the assembled perpendicular orientation toward a co-planar relationship when in a relaxed and unassembled position, whereby when assembled each column will exert a bias on the threads of said bolt to resist disassembly.

13. The shelving of claim 12, wherein said skirt portion includes a lower portion having one part extending inwardly from the bottom of said outer wall portion, another part extending upwardly from said one part for forming an upwardly facing nut blocking surface spaced below an aperture in said skirt portion for accommodating placement of a central threaded bore of a nut upon a correspondingly threaded shaft of a fastener extending through aligned apertures in said skirt portion and said side wall, for subsequently engaging said nut as threaded along said shaft and for impeding rotation of said nut as said nut is drawn toward said aligned apertures, said aperture in said skirt portion being spaced below the adjacent lower most surface of said support portion for accommodating said placement and rotation of the nut wherein a nut maybe easily initially threaded onto a fastener passing through aligned apertures in said skirt portion and said column side wall whereby the nut will not thereafter turn when threaded along said shaft and drawn toward said aligned apertures, and will hold against turning through positive interference with said nut locking surface.

14. The shelving of claim 13, wherein said lower portion of said skirt is generally J-shaped, with the long and short legs of the J-shape being approximately horizontal, the short leg forming said upwardly facing nut locking surface;

said skirt portion further including an upwardly extending inner wall portion generally co-extensive with, spaced from and parallel to said outer wall portion and having a through aperture therein aligned with the aperture in said outer wall portion for receiving the fastener, whereby tightening of the nut and fastener will compress said inner and outer wall portions toward each other and exert a bias on the threads of said assembled fastener and nut to resist disassembly.

15. The shelving of claim 14, wherein the outer wall portion of said skirt includes an inwardly extending rib horizontally aligned with and parallel to the nut locking surface.

16. The shelving of claim 14, wherein said skirt portion further includes a terminal flange integrally extending outwardly from the uppermost portion of said inner wall portion and being generally horizontal to the inside surface of said outer wall portion, whereby compression of said inner and outer wall portions by tightening the nut and fastener will symmetrically compress the inner and outer wall portions only at their mid portions as the uppermost and lower most portions of said inner and outer wall portions are respectively held at their initial spacing by said lower return portion and said terminal flange.

17. The shelving of claim 16, wherein said planar support portion includes an upwardly extending integral rib at the periphery having said skirt portion, for nestingly receiving therein said terminal flange in an interlocking manner whereby said upwardly extending integral rib also both reinforces said shelf and forms a ledge to resist sliding movement of articles support on said shelf in a direction off of the periphery.

18. The shelving of claim 16, further comprised of said planar support portion having an integral upwardly extending rib along all four edges for resisting sliding movement of articles off of said shelf.

19. The shelving of claim 16, wherein the outer wall portion of said skirt includes an inwardly extending rib horizontally aligned with and parallel to the nut locking surface.

20. The shelving of claim 11, further comprised of said column side wall being planar and adapted to be tightly clamped in engagement with said skirt outer wall portion by a nut and fastener.

21. Shelving, comprising:

a plurality of bent sheet metal columns to be vertically arranged in spaced parallel relationship, and each having at least one sheet metal side wall having at least one aperture;

at least one bent sheet metal shelf having a main planar support portion to be horizontally arranged within said columns, and an integrally formed generally vertically extending skirt portion having a horizontal aperture therethrough to be aligned with the horizontal aperture in an adjacent one column side wall for receiving a threaded bolt therethrough so that a nut threaded on the bolt will supportingly clamp said shelf on said one column;

said skirt portion including an upper portion integral in one piece with the sheet metal of said planar support portion, a depending outer wall portion, an inwardly and upwardly bent sheet metal portion, and an upwardly extending inner wall portion generally co-extensive with, spaced from and parallel to said outer wall portion and having a through aperture therein aligned with and substantially the same size as the aperture in said outer wall for receiving the bolt, so that tightening of the nut and bolt will compress said inner and outer wall portions towards each other and exert a bias on the threads of said assembled nut and bolt to resist disassembly.

22. The shelving of claim 21, wherein said skirt portion further includes a terminal flange intergrally extending outwardly from the uppermost portion of said inner wall portion and generally horizontally to the inside surface of said outer wall portion, so that compression of said inner and outer wall portions by tightening the nut and bolt will symmetrically compress the inner and outer wall portions only at their midportions as the uppermost and lowermost portions of said inner and outer wall portions are respectively held at their initial spacing by said inwardly and upwardly bent sheet metal portion and said terminal flange.

23. The shelving of claim 22, wherein said planar support portion includes an upwardly extending integral rib at the periphery having said skirt portion, for nestingly receiving therein said terminal flange in an interlocking manner and so that said upwardly extending integral rib also both reinforces said shelf and forms a ledge to resist sliding movement of articles supported on said shelf in a direction off of the periphery.

24. The shelving of claim 23, wherein each of said columns is, in cross-section, of a W-shape having outermost legs formed by two of said column side walls, and shorter interconnecting innermost legs, with said innermost legs being perpendicular to each other and respectively perpendicular to their adjacent outermost legs;

said shelf being of rectangular shape, with depending skirt portions on four sides of the rectangular shape, and adjacent depending skirt portions at each corner of the shelf being spaced from each other to receive therebetween the innermost legs of the adjacent column; and said apertures being aligned in each skirt portion and each column outermost leg for receiving respectively two bolts at each corner.

25. The shelving of claim 21, wherein each of said columns is, in cross-section, of a W-shape having outermost legs formed by two of said column side walls, and shorter interconnecting innermost legs, with said innermost legs being perpendicular to each other and respectively perpendicular to their adjacent outermost legs;

said shelf being of rectangular shape, with depending skirt portions on four sides of the rectangular shape, and adjacent depending skirt portions at each corner of the shelf being spaced from each other to receive therebetween the innermost legs of the adjacent column; and said apertures being aligned in each skirt portion and each column outermost leg for receiving respectively two bolts at each corner.

26. The shelving of claim 25, wherein the orientation of the legs of the W-shape of each of said columns is perpendicular when assembled; and said legs being oriented from the assembled perpendicular orientation toward a coplanar relationship when in a relaxed unassembled position, so that when assembled, each column will exert a bias on the threads of said assembled nut and bolt to resist disassembly.

27. The shelving of claim 21, wherein:

said inwardly and upwardly bent sheet metal portion including an approximately J-shape with long legs and short legs of the J-shape being generally horizontal;

said long leg of the J-shape extending inwardly from the bottom of said outer wall portion;

said short leg of the J-shape forming an upwardly facing fastener engaging surface spaced below said through aperture for accommodating engagement of a nut with a correspondingly threaded shaft of a fastener extending through aligned apertures in said skirt portion and said inner wall portion, and for engaging the nut and impeding rotation of the nut as the nut is drawn toward the aligned apertures, said aperture in said inner wall portion being spaced below the adjacent lowermost surface of said planar support portion for accommodating placement and rotation of the nut, whereby the nut may be easily initially threaded onto a fastener passing through aligned apertures in said skirt portion and said inner wall portion whereby the nut will subsequently engage and not thereafter rotate when threaded along the shelf as drawn toward said aligned apertures, and will be impeded in rotation due to positive interference with said fastener locking surface.

28. The shelving of claim 27, wherein said planar support portion includes an upwardly extending integral rib at the periphery having said skirt portion, for nestingly receiving therein said terminal flange in an interlocking manner, whereby said upwardly extending integral rib also both reinforces said shelf and forms a ledge along the periphery.

29. The shelving of claim 27, wherein said upwardly extending inner wall portion includes a terminal flange integrally extending outwardly from the uppermost portion of said inner wall portion and generally horizontally to the inside surface of said outer wall portion, whereby compression of said inner and outer wall portions by tightening the nut and bolt will symmetrically compress the inner and outer wall portions only at their midportions as the uppermost and lowermost portions of said inner and outer wall portions are respectively held at their initial spacing by said lower return portion and said terminal flange.

30. A shelving unit, comprising:

a plurality of bent sheet metal columns to be vertically arranged in spaced parallel relationship, each of said columns having at least one sheet metal side wall perforated by at least one horizontal aperture;

at least one bent sheet metal shelf having a main planar support portion to be horizontally arranged within said columns, and an integrally formed generally vertically extending skirt portion having a horizontal aperture therethrough to be aligned with the horizontal aperture in an adjacent side wall of one of said plurality of columns for receiving a threaded fastener therethrough wherein a nut threaded on the fastener will supportingly clamp said shelf on said one of said plurality of columns;

said skirt portion including an upper portion providing a top integral and in one piece with the sheet metal of said planar support portion, an outer wall portion downwardly depending from said upper portion, a lower portion having one part extending inwardly from the bottom of said outer wall portion, another part extending upwardly from said one part for forming an upwardly facing nut locking surface spaced below said aperture in said skirt portion for accommodating placement of a central threaded bore of a nut upon a correspondingly threaded shaft of a fastener extending through aligned apertures in said skirt portion and said side wall, and as said nut is threaded along said shaft, for subsequently engaging said nut and impeding rotation of said nut as said nut is drawn toward said aligned apertures; and said aperture in said skirt portion being spaced below the adjacent lowermost surface of said planar support portion for accommodating said placement and rotation of the nut, whereby a nut may be easily initially threaded onto a fastener passing through aligned apertures in said skirt portion and column side wall so that the nut will not thereafter turn when threaded along said shaft and drawn toward said aligned apertures, and will hold against turning only due to positive interference with said nut locking surface.

31. The shelving of claim 30, wherein said portion of said skirt portion is generally J-shaped, with the long and short legs of the J-shape being horizontal, the short leg forming said upwardly facing nut locking surface;

said skirt portion further including an upwardly extending inner wall portion generallyl-co-extensive with, spaced from and parallel to said outer wall portion and having a through aperture therein aligned with the aperture in said outer wall portion for receiving the fastener, whereby tightening of the nut and fastener will compress said inner and outer wall portions toward each other and exert a bias on the threads of said assembled nut and fastener to resist disassembly.

32. The shelving of claim 31, wherein said skirt portion further includes a terminal flange integrally extending outwardly generally horizontally to the inside surface of said outer wall portion, so that compression of said inner and outer wall portions by tightening the nut and fastener will symmetrically compress the inner and outer wall portions only at their midportions as the uppermost and lowermost portions of said inner and outer wall portions are respectively held at their initial spacing by said lower return portion and said terminal flange.

33. The shelving of claim 32, wherein said planar support portion includes an upwardly extending integral rib at the periphery having said skirt portion, for nestingly receiving therein said terminal flange in an interlocking manner and whereby said upwardly extending integral rib also both reinforces said shelf and forms a ledge to resist sliding movement of articles supported on said shelf in a direction off of the periphery.

34. The shelving of claim 33, wherein each of said columns is, in cross-section, of a W-shape having outermost legs formed by two of said column side walls, and shorter interconnecting innermost legs, with said innermost legs being perpendicular to each other and respectively perpendicular to their adjacent outermost legs;

said shelf being of rectangular shape, with depending skirt portion on four sides of the rectangular shape, and adjacent depending skirt portions at each corner of the shelf being spaced from each other to receive therebetween the innermost legs of the adjacent column; and said apertures being aligned in each skirt portion and each column outermost leg for receiving respectively two fasteners at each corner.

35. The shelving of claim 32, further comprised of said planar support portion having an integral upwardly extending rib along all four edges for resisting sliding movement of articles off of said shelf.

36. The shelving of claim 32, wherein each of said columns is, in cross-section, of a W-shape having outermost legs formed by two of said column side walls, and shorter interconnecting innermost legs, with said innermost legs being perpendicular to each other and respectively perpendicular to their adjacent outermost legs;

said shelf being of rectangular shape, with depending skirt portions on four sides of the rectangular shape, and adjacent depending skirt portions at each corner of the shelf being spaced from each other to receive therebetween the innermost legs of the adjacent column; and said apertures being aligned in each skirt portion and each column outermost leg for receiving respectively two fasteners at each corner.

37. The shelving of claim 36, said planar support portion having an integral upwardly extending rib along all four edges for resisting sliding movement of articles off of said shelf.

38. The shelving of claim 30, wherein the outer wall portion of said skirt includes an inwardly extending rib horizontally aligned with the nut locking surface and parallel thereto.

39. The shelving of claim 30, further comprised of said column side wall being planar and adapted to be tightly clamped in engagement with said skirt outer wall portion by the nut and fastener.

40. A shelving unit, comprising:

a plurality of columns to be vertically arranged in spaced parallel relation, each of said columns having a side wall perforated by an aperture;

a shelf having a main planar support portion to be horizontally arranged within said columns, and an integrally formed generally vertically extending skirt portion having a horizontal aperture therethrough to be aligned with the horizontal aperture in an adjacent one of said column side walls for receiving a first fastener therethrough whereby the first fastener may engage a second fastener and supportingly clamp said shelf on said one column;

said skirt portion including an upper portion providing a top integral and in one piece with the sheet metal of said planar support portion, and an outer wall portion downwardly depending from said upper portion, a lower portion having one part extending inwardly from the bottom of said outer wall portion, another part extending upwardly from said one part for forming an upwardly facing fastener engaging surface spaced below said aperture in said skirt portion for accommodating engagement of a second fastener with a corresponding first fastener extending through aligned apertures in said skirt portion and said side wall, for subsequently engaging the second fastener and impeding rotation of the second fastener as the second fastener is drawn toward said aligned apertures, and said aperture in said skirt portion being spaced below the adjacent lowermost surface of said planar support portion for accommodating said placement and rotation of the second fastener whereby a second fastener may easily initially engage a first fastener passing through aligned apertures in said skirt portion and column side wall so that the second fastener will not thereafter rotate relative to the first fastener drawn toward said aligned apertures, and will hold against turning due to positive intereference with said fastener engaging surface.

41. The shelving unit of claim 40, wherein:

said lower portion of said skirt position has an approximate J-shape, with a long leg and a short leg of said J-shape being generally horizontal, said short leg forming said upwardly facing fastener engaging surface; and skirt portion further including an upwardly extending inner wall portion generally co-extensive with, spaced-apart from and parallel to said outer wall portion, and having a through aperture therein aligned with the aperture in said outer wall portion for receiving the first fastener, whereby final disposition of the first fastener relative to the second fastener will compress said inner and outer wall portions towards each other and excerpt a bias on the assembled first and second fastener to resist disassembly.

42. The shelving of claim 41, wherein said skirt portion further includes a terminal flange integrally extending outwardly from the uppermost portion of said inner wall portion and generally horizontally to the inside surface of said outer wall portion, whereby compression of said inner and outer wall portions by final disposition of the first and second fasteners will symmetrically compress the inner and outer wall portions only at their midportions as the uppermost and lowermost portions said inner and outer wall portions are respectively held at their initial spacing by said lower return portion and said terminal flange.

43. The shelving of claim 41, wherein said planar support portion includes an upwardly extending integral rib at the periphery having said skirt portion, for nestingly receiving therein said terminal flange in an interlocking manner, whereby said upwardly extending integral rib also both reinforces said shelf and forms a raised ledge along said periphery.

44. The shelving of claim 40, wherein each of said columns is, in cross-section, of a W-shape having outermost legs formed by two of said column side walls, and shorter interconnecting innermost legs, with said innermost legs being perpendicular to each other and respectively perpendicular to their adjacent outermost legs;

said shelf being of rectangular shape, with depending skirt portions on four sides of the rectangular shape, and adjacent depending skirt portions at each corner of the shelf being spaced from each other to receive therebetween the innermost legs of the adjacent column; and said apertures being aligned in each skirt portion and each column outermost leg for receiving respectively two of the first fasteners at each corner.

45. The shelving of claim 40, further comprised of said planar support portion having an integral upwardly extending rib along all four edges of resisting sliding movement of articles off of said shelf.

46. The shelving of claim 45, wherein said upwardly extending inner wall includes a terminal flange integrally extending outwardly from the uppermost portion of said inner wall portion and generally horizontally to the inside surface of said outer wall portion, whereby compression of said inner and outer wall portions by tightening the nut and bolt will symmetrically compress the inner and outer wall portions only at their midportions as the uppermost and lowermost portions of said inner and outer wall portions are respectively held at their initial spacing by said lower return portion and said terminal flange.

47. The shelving of claim 45, wherein the outer wall portion of said skirt includes an inwardly extending rib horizontally aligned with and parallel to the nut locking surface.

* * * * *